United States Patent [19]

Armell

[11] Patent Number: 4,790,381

[45] Date of Patent: Dec. 13, 1988

[54] CENTRALIZING DEVICES FOR USE IN BORE-HOLES

[75] Inventor: Richard A. Armell, St. Cyrus, Scotland

[73] Assignee: Drexel Equipment (U.K.) Limited, London, England

[21] Appl. No.: 118,757

[22] Filed: Nov. 6, 1987

Related U.S. Application Data

[63] Continuation-in-part of Ser. No. 850,666, Apr. 11, 1986, abandoned.

[51] Int. Cl.[4] ..... E21B 17/10

[52] U.S. Cl. ..... 166/241; 73/151; 166/64

[58] Field of Search ..... 166/241, 250, 253, 254, 166/255, 64, 113; 73/151, 152; 175/325; 181/102–106

[56] References Cited

U.S. PATENT DOCUMENTS

| | | | |
|---|---|---|---|
| 1,898,074 | 2/1933 | Bailey | 175/325 |
| 2,899,633 | 8/1959 | Smith et al. | 175/325 |
| 3,789,511 | 2/1974 | Groom et al. | 73/151 X |
| 3,978,939 | 9/1976 | Trouiller | 181/104 |
| 4,067,389 | 1/1978 | Weise | 166/255 |
| 4,549,630 | 10/1985 | Brown | 181/106 |
| 4,557,327 | 12/1985 | Kinley et al. | 166/241 |
| 4,615,386 | 10/1986 | Briscoe | 166/241 |
| 4,619,322 | 10/1986 | Armell et al. | 166/241 |

FOREIGN PATENT DOCUMENTS

| | | | |
|---|---|---|---|
| 1148995 | 4/1985 | U.S.S.R. | 73/151 |
| 2155519 | 9/1985 | United Kingdom | 166/241 |
| 2173533 | 10/1986 | United Kingdom . | |

*Primary Examiner*—Stephen J. Novosad
*Attorney, Agent, or Firm*—Leydig, Voit & Mayer

[57] ABSTRACT

A centralizing device for use down-well in maintaining a sensor or other operational tool in a location accurately centralized on the axis of the bore-hole irrespective of the angular orientation of the device and associated tool at any given location. The device includes an elongate member carrying at angularly spaced locations three two pairs of opposed, two-arm linkages, each arm of each linkage being pivoted to the other arm of that linkage at a location spaced from the elongate member when in an extended position and being pivoted at the other end of the arm to a respective one of two slide blocks each of which is movable axially of the elongate member. Resilient springs act on the slide blocks so as to bias the arms of each linkage towards one another whereby the common pivot axes of the arms are moved away from the elongate member, and rollers or anti-friction members are mounted at the pivot of each linkage of each pair of arms so that the device as a whole can move with minimum friction within the pipe or tube containing the device.

18 Claims, 3 Drawing Sheets

CENTRALIZING DEVICES FOR USE IN BORE-HOLES

This application is a continuation-in-part application based on Ser. No. 850,666 to R A Armell, filed Apr. 11, 1986, and now abandoned.

BACKGROUND OF THE INVENTION

1. Field of the Invention

This invention relates to centralizing devices and to such devices which can additionally be used as down-hole position locators and also when used in tandem to define an axial alignment.

2. Summary of the Prior Art

In down-well operations in the oil and gas production and exploration industries, it is frequently a requirement that a tool, such as position sensors, shall be accurately centralized within the casing pipe or other cylindrical member and this has become even more important as position sensors or logging devices per se have become more and more accurate. Such high accuracy in the sensor itself is of little value if the precise location relative to the casing pipe or other cylindrical member becomes indeterminate because of non-central location of the sensor within the casing pipe.

Again, maintained precision of centralization becomes far more important where logging activities may involve directions ranging from the vertical substantially to the horizontal in the same casing pipe, and presently known devices for maintaining centralization within a casing pipe are not successful in achieving their objective within horizontal bore holes because of the gravity effect. This becomes an even greater problem when the sensing units have considerable length and weigh sometimes over 100 kg. It follows that the amount of support required for such sensing units as a horizontal orientation is approached can be substantial and it is desirable that appropriate support will be provided irrespective of the angular location of the sensing unit at any given location. Clearly, the strength under bending loads becomes more significant under conditions other than truly vertical.

The centralizing device must be able to operate effectively irrespective, within wide limits, of the diameter of the cylindrical structure in which it is working.

Centralizing devices have been proposed for example in U.S. Pat. No. 1,898,074 in which pairs of two-armed linkages are mounted externally of a central elongate member with a mounting assembly at each inner end and means biasing one mounting assembly so that the outer ends of the arms of each two armed linkage are, in turn, biased outwardly so that the outer ends of the arms contact the bore-hole or casing wall. This prior proposal is not, however, satisfactory as the strength is inadequate, more especially when the centralizer must be of slender construction so that it can be used in bore holes or tubing of small internal diameter, say 2¼ inches (6 cm). This problem of inadequate bending strength is magnified when, as is usually the case, the centralizers are used in tandem so that the overall length of the whole, including a sensing instrument between them, may be as much as 30 feet (10 meters) and, furthermore the assembly is used in a non-vertical orientation.

U.S. Pat. No. 4,549,630 to Graydon L Brown issued Oct. 29, 1985 discloses a device superficially similar to a centralizer, but the purpose is quite different, namely the transmission of shear wave energy to a bore hole.

Strength is not therefore a primary requirement and there is no requirement for this device to operate in tandem with another.

U.S. Pat. No. 4,619,322 to Richard A Armell issued Oct. 28, 1986 discloses a centralizer including a central elongate body member supporting a plurality of two-armed linkages mounted inwardly on slide blocks movable on the central member. However the slide blocks lie outside of the elongate body member and, particularly for small diameter centralizers the bending strength is inherently not as high as desirable.

U.S. Pat. No. 3,789,511 to Groom et al issued Feb. 5, 1974 relates to a device for measuring the curvature of a pipeline. Once again a central elongate member is provided together with spring-loaded two-arm linkages, but the arms are mounted entirely externally to the elongate member so that for any given diameter of the latter the strength in bending is not as high as is necessary for applications contemplated by the present invention.

U.S. Pat. No. 2,899,633 to O. R. Smith et al issued Apr. 5, 1956 has some similarities to a centralizer, but there is no requirement to centralize within a borehole and no requirement for tandem operation. It is not apparent that any attempt has been made to provide a construction with high bending strength.

One object of the invention is to provide a centralizing device which can more readily be used within casings and tubings of differing inner diameters and which has adequate bending strength even when the bore hole diameter requires a centralizer of very small size.

In addition to centralizing, there is also a requirement for certain down-hole operations to establish substantially exactly an axial alignment within the tubing or casing and it is therefore another object of the present invention to provide an assembly which will define such a substantially exact axial alignment down-hole.

It is a further object of the invention to provide a bore hole centralizer in which spring-loaded arms of two-armed linkages exert a constant pressure against the bore-hole wall irrespective, substantially, of the angular configuration of the arms in any bore-hole over a range of diameters.

SUMMARY OF THE INVENTION

According to the present invention there is provided an assembly of a centralizing device and a sensor or other operational tool, the device being for use down-well in maintaining the sensor or other operational tool in a location accurately centralized on the axis of the bore hole irrespective of the angular orientation of the device and tool at any given location, said device comprising an elongate body member having a longitudinal axis, which axis is, in use, maintained coincident with the longitudinal axis of the bore hole, the elongate body member having a plurality of spaced slots distributed around its circumferential surface, each said slot extending parallel to said longitudinal axis, a corresponding plurality of two-armed assemblies spaced around the longitudinal axis of the elongate body member, each arm of each assembly being pivotally connected at a radially outer location at end portions of the arms, and capable of being accommodated substantially wholly within the envelope defined by the elongate body member when the arms are in a retracted configuration, radially outer pivots providing the pivotal connection at the radially outer end portions of the respective said arms, two slide blocks each having external cross-sections within the confines of the outer cross section of the elongate body member, each slide block defining a plurality of recesses corresponding to the number of two-armed assemblies, each said recess receiving an inner end portion of a said arm, and means retaining the respective inner end portions of the arms in a respective one of the slide blocks, anti-friction members, each mounted at a said radially outer pivot of the two armed assemblies and intended for contacting engagement with the surrounding structure of the bore hole, means at each end of the elongate body member for connecting it, when required, to an adjacent said operational tool or other component, and resilient means acting on at least one of said slide blocks to bias the two-armed link assemblies outwardly from the body member so that the anti-friction members are always, in use, in contact with surrounding structure of the bore hole.

BRIEF DESCRIPTION OF THE DRAWINGS

A centralizing device embodying the invention will now be described, by way of example only, with reference to the accompanying diagrammatic drawings, in which.

DESCRIPTION OF THE PREFERRED EMBODIMENT

Figures 1, 2:
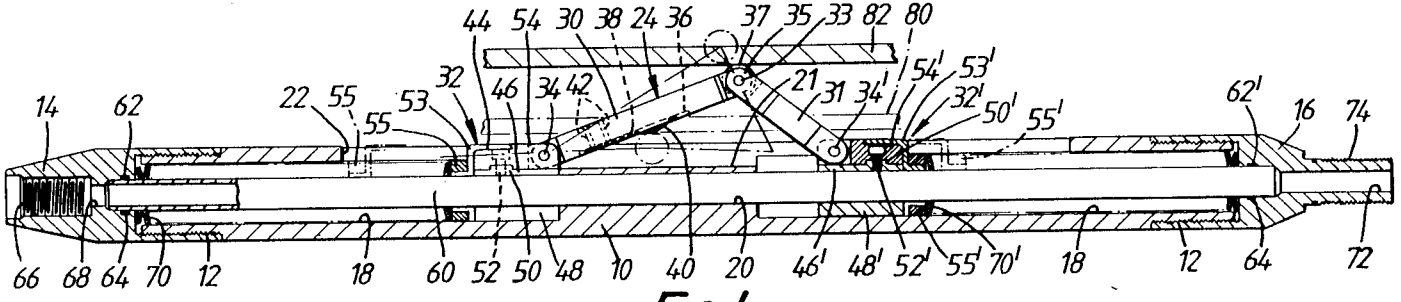
FIG. 1 is a longitudinal section of a centralizing device embodying the invention.
FIG. 2 is a view similar to FIG. 1, but simplified and showing the device in an alternative configuration and with certain differently dimensioned parts.

In any given casing pipe or other cylindrical member or structure the range of internal diameters may be substantial but it is an operational requirement that sensing devices and other tools or apparatus should be accurately centered irrespective of the internal diameter of the corresponding structure at any given location.

The first two Figures illustrate the range of pipe internal diameters which can be accommodated successfully by the centralizing device in accordance with the preferred embodiment. The larger diameter pipe is nominally 244 mm (9⅝ inches) outside diameter while the smaller diameter pipe is in the range 63 mm to 60 mm (2½ inches to 2⅜ inches). As will be apparent from FIGS. 1 and 2, the device in accordance with the present invention can readily accommodate this wide range of pipe diameters.

Turning now to the details, the centralizing device includes a center body or other elongate member 10 having an annular cross-section. However, the internal bore varies in diameter along the length, whereas the external diameter remains substantially constant, to define an outer cylindrical envelope, over the whole length of the device. At each end, the external diameter of the body has a reduced diameter, externally screw-threaded, portion 12, the left hand, as shown, (the lower end when in use) receiving a cross-over box 14 and the right hand end end portion receiving a cross-over pin 16. These parts will be described in greater detail hereinafter.

Internally, the body has two relatively large diameter, uninterrupted, bores 18, one towards each end portion of the device and a central portion 20 of reduced diameter. The center body 10 is interrupted by three elongate, equally peripherally spaced, slots 22 (only one shown in FIGS. 1 and 2) and each slot fully receives, when retracted, one two-armed assembly 24. Considered lengthwise the reduced diameter portion 20 of the internal diameter of the body lies intermediate the ends of the slots but not centrally of the ends because the left-hand end (as illustrated) of the reduced diameter portion is closer to the cross-over box 14 than the right-hand end of the portion 20 is to the cross-over pin 16.

The central portion 20 of reduced diameter is itself divided by the slots 22 so that as shown in FIG. 1 the thickness of the center body is appreciably reduced at 21 so as to receive in the retracted configuration the corresponding one of the two-armed assemblies 24. It will be apparent that by virtue of the facility of accommodating fully the two-armed linkages in their retracted configuration within the envelope of the alongate body member, it becomes possible to provide the latter with a larger diameter and thus higher stiffness in bending than is the case with prior centralizers in which the linkage are arranged externally of the member 10 and the slide blocks are external to the tubular body member.

Reference will now be made to the two-armed assemblies, only one of which is shown in each of FIGS. 1 and 2. Since the three assemblies are identical, only one will be described in detail.

As will be apparent from the Figures, the arms of each assembly may be of the same length, as in FIG. 2, or of different lengths as in FIG. 1. The lower arm 30 (left-hand arm in FIG. 1) is received at its lower end in a slide block generally referenced 32, and is retained by a pin 34 which passes through a part of the block.

The arm 30 has an elongate recess 36 (broken lines) which partially accommodates a leaf spring 38 (broken lines) having a bend portion 40 which protrudes slightly from the recess 36. The end of the spring remote from the bend portion 40 is secured to the arm by rivets 42 (broken lines).

The end of the arm 30 remote from the slide block 32 is pivoted to the upper arm 31 of the assembly by a pin 33 which passes through a bifurcated portion 35 of the arm 31, the pin 33 also serving to mount a freely rotatable roller 37 or other anti-friction member. The end of the arm 31 remote from the pivot pin 33 is pivotally mounted on an upper slide block 32' by means of a pin 34'.

One of the two slide blocks 32,32' will now be described in detail, corresponding parts of the slide block 32' being given the same reference numerals, but with the addition of a prime.

Each block 32,32' is made up of several components as follows. A sleeve 44 which is slidably mounted on a center tube 60 of the centralizing device effectively defines three recesses or slots for receiving an end portion of one of the arms and to do this the block effectively has outer diameter portions of different diameters to the bases of the recesses distributed peripherally. The three reduced diameter portions effectively define the bases of the slots or recesses and three larger diameter portions 48 extend substantially to the inner diameter of the main body 10 of the centralizing device.

In order to provide for the pivoting action of the arms received in the slide block each of the recesses or slots defined by the reduced diameter portions 46 receives an insert 54 which fits over a boss 50 of the smaller diameter portion 46 and is secured to the latter by a set screw 52 held by a retainer 53. Each retainer is itself held by a ring 55 the outer diameter of which is approximately the same as the inner diameter of the main body 10. Each insert 54 is itself provided with a slot receiving the end portion of the corresponding arm and the portions of the insert defining the slot each have bores receiving the pin 34.

The two slide blocks 32,32' are under the influence of respective springs 70,70' built up from a plurality of Belleville washers, the left-hand or lower spring having a higher stiffness than the right-hand or upper springs. It will be readily apparent that the springs 70,70' act to extend the two-armed assemblies outwardly so that when the assemblies are forced inwardly the springs will be contracted and will store energy so that when a larger diameter length of tubing or pipe is encountered the two-armed assemblies will automatically extend outwardly thus maintaining a central location of the device and an associated tool.

It is possible with Belleville washers to store large quantities of energy in a relatively small space and this means that even when the centralizing device is lying in a particularly large diameter bore-hole the spring stiffness will still be fully adequate to support loads when the centralizing device is in a substantially horizontal orientation.

As is apparent from FIG. 1 the cross-over box and the cross-over pin receive respective end portions of the center tube 60 and sealing with respect thereto is achieved by an O-ring seal 62 and a small disc spring 64. The cross-over box 14 is generally conventional and has a relatively large diameter rapped bore 66 which communicates with a relatively small diameter bore 68 which in turn communicates with the interior of the tube 60. The cross-over pin 16 has only a single diameter bore 72 which communicates with the interior of the tubular member. Externally it has a threaded end portion 74.

In FIG. 1 the extreme left-hand position of the retaining ring 55 of the slide block 32 is illustrated in chain lines and the right-hand extreme position of the retaining ring 55' of the right-hand slide block 32' is again illustrated in chain lines. It will be apparent that the block 32 then lies close to the left-hand end of the slot 22, while the block 32' is well spaced from the right hand end of slot 22. The dimensions of the slot 22 thus enable alternative two-armed assemblies such as illustrated in FIG. 2 to be substituted in the same basic centralizing device.

The centralizing device which has just been described is simple in construction and will be operable satisfactorily in the harsh conditions encountered in the oil and gas industries, the use of Belleville washers 70 ensuring that even in the event of fracture of one or more washers the spring force will still be adequate to ensure proper support even when the device is in a horizontal position. The rollers 37 at the connecting pivot point of each two armed assembly can be replaced by skids, but it is believed that minimum friction is achieved with the construction as illustrated. The range of tubing size which can be accommodated by the two-armed assembly as shown in FIG. 1 is indicated by a portion of nominal 90 mm (3") tubing 80 and a portion of nominal 178 mm (7") tubing 82. Turning now to FIG. 2, it will immediately be apparent that the construction is generally similar to that of FIG. 1 but the two-armed assembly 24" has arms 30",31" of equal length while springs 70" of different stiffness are retained.

To ensure that the safe operating range is not exceeded, a central tube spacer 86 is provided so that the right-hand (upper) slide block 32" cannot move an excessive distance up the central tube 60" which might mean that the spring force applied is inadequate properly to support the device under horizontal loading conditions. Otherwise the modification of FIG. 2 differs little from the embodiment of FIG. 1, and indeed the basic construction is intentionally identical so that the two-armed assemblies can easily be exchanged. The device of FIG. 2 can operate with a tubing having a nominal diameter of 244 mm (9⅝ inches).

In use, two centralizing devices either as shown in FIG. 1 or FIG. 2 will be employed with a sensor or other instrument or tool (not shown) being mounted between the devices. By the provision of three centralizing two-armed link assemblies in each device it is possible to provide for a very wide range of internal diameter of the casing pipe for any given centralizing device. The interchangeability illustrated by FIGS. 1 and 2 further enchances this range. In addition the inventory of the user can be kept to a minimum since any given centralizer will be operable for most of the conventionally used casing sizes. The disc springs or Belleville washers are used when the tool is in operation with coil tubing but each spring assembly is replaced with one helical compression spring when in use with a wireline.

Figure 3:
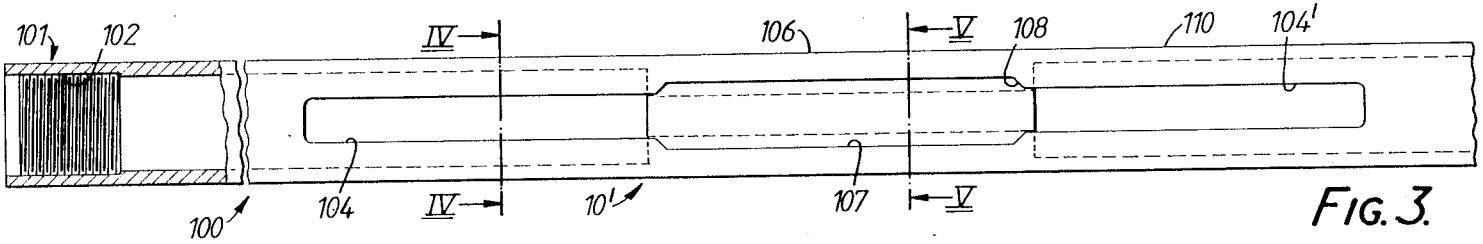
FIG. 3 is a side elevation, partly in section of an elongate body member of the device of FIGS. 1 and 2.
Figure 5:
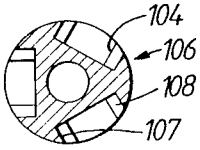
FIG. 5 is a cross-section on the line V—V of FIG. 4.
Figure 4:
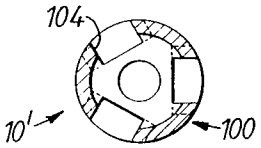
FIG. 4 is a cross-section on the line IV—IV of FIG. 3.

In view of the importance of resistance to bending when the centralizer is used in tandem with another centralizer, the operational sensor or other operating tool being connected between them, details of the tubular body member 10 have been illustrated in FIG. 3, 4 and 5. The member 10' is not identical to the member 10 of FIGS. 1 and 2 but is generally similar.

The tubular body member 10' is clearly elongate and the break lines indicate that as shown the full extent of the elongation is not apparent from FIG. 3. Typically for an elongate body 1 11/16" (4.29 cms) in diameter the overall length will be approximately 29" (74 cms) and this makes very clear the need for adequate stiffness if the dimensional accuracy is to be maintained. Considering the tubular body member 10' from left to right in the drawing, the left hand portion 100 has an end portion 101 which is internally screw threaded at 102 for connection purposes and towards the centre of this left hand portion the required three slots 104 are provided which accommodate the links of the two-armed linkage assemblies referred to in relation to FIGS. 1 and 2.

One of the slide blocks, (not shown in this Fig.) again initially mentioned with reference to FIGS. 1 and 2, is received within the internal bore of portion 100 and if desired, the slide block alternatively slides on a central elongate tubular member (not shown in FIG. 3) as illustrated in FIGS. 1 and 2. The number of two-armed linkages is preferably three since, as will be readily apparent from FIGS. 4 and 5 the provision of a larger number would require that the linkages should be relatively slender and thus not robust and provision of additional slots would also have the effect of weakening the elongate body member itself. However, it cannot be excluded that further two-armed linkages would be provided, although less than three is not practical from the point of view of force-balancing.

A central portion 106 of the elongate tubular member, a cross-section of which is illustrated in FIG. 5 includes wider portions 107 of the slots which join the narrower portions at tapers 108 as illustrated in FIG. 3. As will be seen from FIG. 5, the strength of the center portion in bending is maintained substantially constant with the strength in bending of the left hand (and right hand) portion by providing more solid material towards a central bore which, if employed, accommodates the elongate central tubular member 60 already referred to. The purpose of the wider slot of the central portion is, of course, to accommodate the relatively wider part of the corresponding two-armed assembly where the anti-friction member is mounted in the form of a roller as illustrated in FIGS. 1 and 2.

The right hand end portion referenced 110 is a mirror image of the left hand portion 100 including an end portion 101' serving for coupling purposes. Other parts of the right hand portion are similarly given corresponding reference numerals with the addition of a prime.

Figure 6:
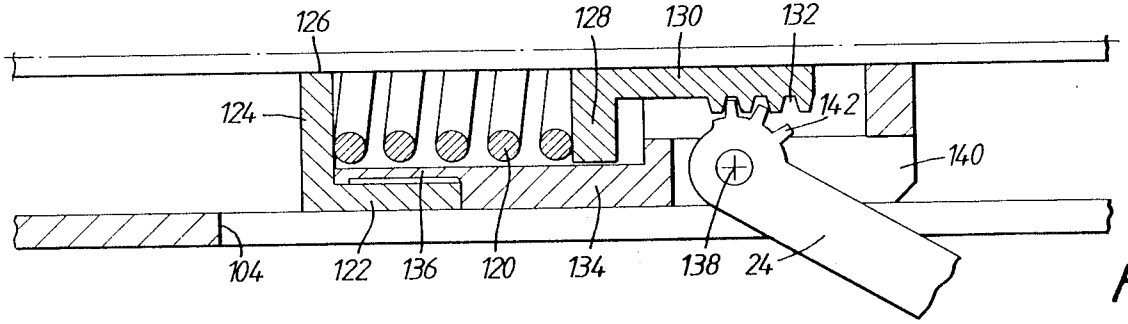
FIG. 6 is a fragmentary, half longitudinal section showing a modification of the device of FIGS. 1 to 5.

FIG. 6 illustrates a modification of the embodiments of FIGS. 1 to 3 and FIGS. 1 to 3 as modified by FIGS. 4 and 5 in which, essentially, the configuration of the inner end of each link of each two-armed linkage assembly 24 has been changed together with changes in the slide block. The portion of the tubular body member illustrated corresponds to the left or right hand portion 100 or 110 where the slots 104 are relatively narrow. A resilient means, here in the form of a helical compression spring 120 is partly accommodated within a hollow cup-like member 122 with a transverse end flange 124 having a central aperture 126 through which the elongate tubular central member 60 can pass, if provided. The other end of the helical spring 120 contacts a flange 128 of a cylindrical member 130 provided with annular grooves 132 which in cross-section define ridges of tooth-like form. In an alternative construction the cylindrical member is divided into a plurality of angularly spaced blocks, each block having grooves of part annular form. The flange 128 of the hollow cylindrical member 130 can slide within a further, fixed, hollow cylindrical member 134 which is a tight fit within the bore of the hollow tubular member 10 of the device. The cylindrical hollow member 134 has an extension 136 of reduced external diameter which abuts the inner face of the cup-like member 122 which accommodates the helical spring 120.

As illustrated in FIG. 6 an inner end portion of one of the arms 24 of one of the two-armed linkages is pivotally mounted at 138 in a recess 140 provided in the member 134 of the slide block and the end portion of the arm also has one or more teeth 142 of corresponding pitch to the teeth of the movable hollow cylindrical member 130 which is biased by the helical spring 120 in a direction to cause the arm to move outwardly towards the bore-hole wall.

To prevent excessive outwards motion of the arms, stop abutments are provided intermediate the slide blocks, as in the first embodiment.

As will be readily apparent, the helical spring 120 biases the arm in the outward direction but when the bore hole is reduced in diameter the arm will cause the spring to be compressed until such time that the arm illustrated, and each of the other arms of the device are fully accommodated within the envelope of the tubular body member. As will be readily apparent the slide block corresponding to the other arm of each two armed assembly will be a mirror image of the slide block assembly illustrated in FIG. 6.

At least where the centralizing device is to be used with wireline the following uses/advantages will arise:

1. The prime purpose of centralizing will be effective;
2. Within limits the weight of the device itself and associated equipment will be adequately supported irrespective of orientation;
3. One centralizing device can be used with various casing sizes;
4. Friction is reduced during movement in comparison with known devices;
5. The device also acts as a shock absorber;
6. It is possible to "count collars", that is when the force arising as two pipes are joined by a collar is generated, the weight indicator associated with the string will jerk when that collar mates with the recesses of the adjacent flanges of the joint.
7. The device can be used to locate seating nipples such as are provided in a string of packers or tools.
8. The centralizing device provides a facility for passage of a conductor cable;
9. The centralizer can be used as an accurate tubing end locator; and
10. The main tubular body encompasses within it the slide blocks so that the diameter of the body can be almost identical with the smallest bore-hole in which it can be used, thus ensuring maximum strength.

Where the centralizing device is used in association with endless tubing it is possible to support loads of at least 72 Kg (158 lb).

The centralizer acts with endless tubing as an anti-torque device when running downhole motors.

By the use of central tubing through a centralizer it is possible to circulate fluids.

Other advantages and uses apply to endless tubing as to wireline.

If desired the anti-friction members in the form of wheels can be replaced by skids.

The centralizer as hereinbefore described can alternatively be used as a tubing end locator. At the end of a tube the two-armed assemblies will spring outwardly thus providing the possibility, by applying an upwards pulling force, of generating a signal which can be received at the upper end of the bore-hole. This applies irrespective of upwards or downwards motion of the centralizer.

As already mentioned hereinbefore, it is a requirement in certain down-hole operations to define an axial alignment over a length of tubing or, more broadly, within a bore-hole. This can be effected by providing two centralizers in accordance with any of the preferred embodiments, arranged at a desired spacing. It is then no longer essential that the two-armed linkages shall be equally spaced around the elongate body member.

What is claimed is:

1. An assembly of a centralizing device and a sensor or other operational tool, the device being for use down-well in maintaining the sensor or other operational tool in a location accurately centralized on the axis of the bore hole irrespective of the angular orientation of the device and tool at any given location, said device comprising an elongate body member having a longitudinal axis, which axis is, in use, maintained coincident with the longitudinal axis of the bore hole, the elongate body member having a plurality of spaced slots distributed around its circumferential surface, each said slot extending parallel to said longitudinal axis, a corresponding plurality of two-armed assemblies spaced around the longitudinal axis of the elongate body member, each arm each assembly being pivotally connected at a radially outer location at end portions of the arms, and capable of being accommodated substantially wholly within the envelope defined by the elongate body member when the arms are in a retracted configuration, radially outer pivots providing the pivotal connection at the radially outer end portions of the respective said arms, two slide blocks each having external cross-sections within the confines of the outer cross section of the elongate body member, each slide block defining a plurality of recesses corresponding to the number of two-armed assemblies, each said recess receiving an inner end portion of a said arm, means retaining the respective inner end portions of the arms in a respective one of the slide blocks, anti-friction members, each mounted at a said radially outer pivot of the two-armed assemblies and intended for contacting engagement with the surrounding structure of the bore hole.

means at at least one end of the elongate body member for connecting it, when required, to an adjacent said operational tool or other component, and resilient means acting on at least one of said slide blocks to bias the two-armed assemblies outwardly from the body member so that the anti-friction members are always, in use, in contact with surrounding structure of the bore hole.

2. A device according to claim 1 wherein the slots of the elongate body member include relatively narrow portions at each end having a width sufficient to enable accommodation of the arms of the corresponding two armed assemblies and a relatively wider portion intermediate the narrow portions and having a width sufficient to accommodate at least partially those parts of the arms mounting the anti-friction members when the two-armed assemblies are in their retracted configuration.

3. A device according to claim 2, wherein the relatively narrower portions of the elongate slots are each substantially coincident, lengthwise of the elongate body member, with a hollow cylindrical portion of the elongate body member which hollow cylindrical portion accommodate internally a respective said slide block.

4. A device according to claim 3 wherein a central portion of the elongate body member corresponding substantially to the length of the relatively wider portion of each slot has a central bore having a diameter corresponding dimensionally substantially to the width of the narrower portions of each slot.

5. A device according to claim 1 wherein each slide block has one end serving as an abutment for the resilient means, and the other end portion of the slide block and an inner end portion of a corresponding arm of a said two-armed link assembly being conformed so to cooperate that under the action of the resilient means the said corresponding arm is caused to pivot outwardly, the force acting on the arm remaining substantially constant irrespective of the angular position by virtue of the operative conformation between the said end portions.

6. A device according to claim 5, wherein each said end portion is formed with at least one tooth.

7. A device according to claim 1, wherein each slide block has a boss in each recess which boss provides a location for a corresponding insert, the insert being secured to the block by a set screw engaged in a tapped bore of the boss.

8. A device according to claim 7 comprising means for retaining the inserts in each respective recess.

9. A device according to claim 8, wherein the retaining means comprises a retainer acting on each set screw, and a ring serving to retain the retainers on the elongate body member.

10. A device according to claim 1, wherein each resilient means is a stack of Belleville washers.

11. A device according to claim 1, comprising a spring mounted on the side of one arm of each of the two-armed assemblies, which spring serves to prevent the assembly from adopting an over-center position in a radial inwards direction.

12. A device according to claim 9, wherein the resilient means each directly abut a respective said ring of the retainer means.

13. A device according to claim 10, wherein the resilient means are of unequal stiffness.

14. A device according to claim 9, wherein each retainer has a portion thereof accommodated in a peripheral recess of the corresponding insert, the recess being undercut to receive a chamfered end edge of said portion of the retainer.

15. An assembly of a centralizing device and a sensor or other operational tool, the device being for use down-well in maintaining the sensor or other operational tool in a location accurately centralized on the axis of the bore hole irrespective of the angular orientation of the device and tool at any given location, said device comprising an elongate body member having a longitudinal axis, which axis is, in use, maintained coincident with the longitudinal axis of the bore hole, the elongate body member having a plurality of spaced slots distributed around its circumferential surface, each said slot extending parallel to said longitudinal axis, a corresponding plurality of two-armed assemblies spaced around the longitudinal axis of the elongate body member, each arm of each assembly being pivotally connected at a radially outer location at end portions of the arms, and capable of being accommodated substantially wholly within the envelope defined by the elongate body member when the arms are in a retracted configuration, radially outer pivots providing the pivotal connection at the radially outer end portions of the respective said arms, two slide blocks each having external cross-sections within the confines of the outer cross section of the elongate body member, each slide block defining a plurality of recesses corresponding to the number of two-armed assemblies, each said recess receiving an inner end portion of a said arm, each said slide block serving as an abutment for the resilient means at one end portion thereof, and having conformation means at the other end portion thereof, and each inner end portion of each arm of each said two-armed linkage having conformation means co-operating with corresponding said conformation means of the slide block the action of the resilient means on the hollow slide blocks being such that the conformation means of the slide blocks and of the arms causes the arms to pivot outwardly, the force acting on the arms being substantially constant irrespective of the angular orientation by virtue of the co-operating conformation means of the slide blocks and of the arms.

16. An assembly according to claim 15 wherein each said conformation means is in the form of at least one tooth-like member.

17. An assembly according to claim 15, wherein each slide block comprises several part cylindrical blocks angularly arrayed around the longitudinal axis of the body member.

18. An assembly comprising two centralizing devices for use down-hole in defining an axial alignment within the borehole, each said centralizing device comprising, an elongate body member having a longitudinal axis and having a plurality of spaced slots distributed around its circumferential surface, each said slot extending parallel to said longitudinal axis, a corresponding plurality of two-armed assemblies spaced around the longitudinal axis of the elongate body member, each arm of each assembly being pivotally connected at a radially outer location at end portions of the arms, and capable of being accommodated substantially wholly within the envelope defined by the elongate body member when the arms are in a retracted configuration, radially outer pivots providing the pivotal connection at the radially outer end portions of the respective said arms, two slide blocks each having external cross-sections within the confines of the outer cross section of the elongate body member, each slide block defining a plurality of recesses corresponding to the number of two-armed assemblies, each said recess receiving an inner end portion of a said arm, means retaining the respective inner end portions of the arms in a respective one of the slide blocks, anti-friction members, each mounted at a said radially outer pivot of the two-armed assemblies and intended for contacting engagement with the surrounding structure of the bore hole, means at at least one end of the elongate body member for connecting it to the other said centralizing device, and resilient means acting on at least one of said slide blocks to bias the two-armed assemblies outwardly from the body member so that the anti-friction members are always, in use, in contact with the surrounding structure of the bore-hole, the devices together defining an axial alignment between them.

* * * * *